US007411570B2

(12) United States Patent
Kawase et al.

(10) Patent No.: US 7,411,570 B2
(45) Date of Patent: Aug. 12, 2008

(54) METHOD OF DRIVING PLASMA DISPLAY PANEL AND PLASMA DISPLAY PANEL IN WHICH A DIFFERENCE BETWEEN STARTING TIMINGS OF THE SUSTAINING TIME PERIODS IN ADJACENT BLOCKS IS SET SUBSTANTIALLY EQUAL TO THE LENGTH OF THE WRITING TIME PERIOD IN THE ADJACENT BLOCKS

(75) Inventors: Toru Kawase, Osaka (JP); Tomoki Nakakita, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 302 days.

(21) Appl. No.: 10/533,130

(22) PCT Filed: Nov. 4, 2004

(86) PCT No.: PCT/JP2004/016700

§ 371 (c)(1),
(2), (4) Date: Apr. 29, 2005

(87) PCT Pub. No.: WO2005/043503

PCT Pub. Date: May 12, 2005

(65) Prior Publication Data

US 2006/0033686 A1 Feb. 16, 2006

(30) Foreign Application Priority Data

Nov. 4, 2003 (JP) ..... 2003-374145

(51) Int. Cl.
*G09G 3/28* (2006.01)

(52) U.S. Cl. ..... 345/63; 345/60

(58) Field of Classification Search ..... 345/37, 345/41, 63–68, 208, 60
See application file for complete search history.

(56) References Cited

U.S. PATENT DOCUMENTS 5,684,499 A * 11/1997 Shimizu et al. ..... 345/60

(Continued)

FOREIGN PATENT DOCUMENTS

JP 9-244578 9/1997

(Continued)

OTHER PUBLICATIONS

M. Ishii et al., "43.2: Driving of PDPs with 208 Sub-Fields Using a Grouped Address-While-Display Scheme", SID International Symposium Digest of Technical Papers, vol. XXXII, Jun. 2001, pp. 1134-1137.

*Primary Examiner*—Richard Hjerpe
*Assistant Examiner*—Shaheda A Abdin
(74) *Attorney, Agent, or Firm*—Wenderoth, Lind & Ponack, L.L.P.

(57) ABSTRACT

One field time period is formed of a plurality of subfields having at least a writing time period and a sustaining time period, of an initialization time period, the writing time period, and the sustaining time period. A display electrode pair is divided into a plurality of blocks. Starting timings of the subfields of the blocks are set to be shifted so that writing timings of two or more blocks of the plurality of blocks do not coincide with each other.

3 Claims, 6 Drawing Sheets

U.S. PATENT DOCUMENTS

| | | | | |
|---|---|---|---|---|
| 6,337,674 | B1 | 1/2002 | Kim | |
| 6,344,841 | B1 | 2/2002 | Moon | |
| 6,362,800 | B1 | 3/2002 | Moon | |
| 6,388,643 | B1 * | 5/2002 | Huang | 345/60 |
| 2002/0018032 | A1 * | 2/2002 | Weitbruch et al. | 345/60 |
| 2004/0085262 | A1 * | 5/2004 | Lee | 345/41 |

FOREIGN PATENT DOCUMENTS

| | | |
|---|---|---|
| JP | 10-149132 | 6/1998 |
| JP | 11-45070 | 2/1999 |
| JP | 11-184427 | 7/1999 |
| JP | 2000-276101 | 10/2000 |
| JP | 2001-265281 | 9/2001 |

* cited by examiner

METHOD OF DRIVING PLASMA DISPLAY PANEL AND PLASMA DISPLAY PANEL IN WHICH A DIFFERENCE BETWEEN STARTING TIMINGS OF THE SUSTAINING TIME PERIODS IN ADJACENT BLOCKS IS SET SUBSTANTIALLY EQUAL TO THE LENGTH OF THE WRITING TIME PERIOD IN THE ADJACENT BLOCKS

TECHNICAL FIELD

The present invention relates to a driving method of a plasma display panel and a plasma display device.

BACKGROUND ART

A plasma display panel (hereinafter referred to as "panel") is a display device that has a large screen, is thin and light, and has high visibility.

A typical alternating-current surface discharge type panel used as the plasma display panel has many discharge cells between a front plate and a back plate that are faced to each other. The front plate has the following elements:

- a plurality of display electrode pairs disposed in parallel on a front glass substrate; and
- a dielectric layer and protective layer for covering the display electrode pairs.

Here, each display electrode pair is formed of a scan electrode and a sustain electrode. The back plate has the following elements:

- a plurality of data electrodes disposed in parallel on a back glass substrate;
- a dielectric layer for covering the data electrodes;
- a plurality of barrier ribs disposed on the dielectric layer in parallel with the data electrodes; and
- phosphor layers disposed on the surface of the dielectric layer and on side surfaces of the barrier ribs.

The front plate and back plate are faced to each other so that the display electrode pairs and the data electrodes three-dimensionally intersect, and are sealed. Discharge gas is filled into a discharge space in the sealed product. In the panel having this configuration, ultraviolet rays are emitted by gas discharge in each discharge cell. The ultraviolet rays excite respective phosphors of red, blue, and green, emit light, and thus provide color display.

A subfield method is generally used as a method of driving the panel. In this method, one field time period is divided into a plurality of subfields, and the subfields at which light is emitted are combined, thereby performing gradation display. Here, each subfield has an initialization time period, a writing time period, and a sustaining time period.

In the initialization time period, initializing discharge is performed simultaneously in all discharge cells, the history of the wall charge for each discharge cell before the initializing discharge is erased, and wall charge required for a subsequent writing operation is formed. In the writing time period, scan pulse voltage is sequentially applied to the scan electrodes, writing pulse voltage corresponding to signals of images to be displayed is applied to the data electrodes, writing discharge is selectively raised between the scan electrodes and the data electrodes, and the wall charge is selectively formed. In the subsequent sustaining time period, a predetermined numbers of sustaining pulse voltages are applied between the scan electrodes and the sustain electrodes, and discharge and light emission are performed selectively in the discharge cells where the wall charge is formed by writing discharge. This method is described in "Whole plasma display", by Hiraki Uchiike and Shigeo Mikoshiba, Kougyou Chosakai Publishing Inc., May 1, 1997, p79-p80, p153-p154, for example.

A driving method allowing suppression of false contours generated by the subfield method is also proposed (for example, Japanese Patent Unexamined Publication No. H11-305726). In this method, only one initializing operation and only one writing operation are performed in a plurality of subfields, thereby continuing subfields in which light is emitted and suppressing the false contours.

In the driving methods discussed above, operations in the initialization time period, writing time period, and sustaining time period are executed by time division, and respective times required for the initializing operation, the writing operation, and the sustaining operation are summed. The driving time becomes therefore long. Therefore, the time assigned to the sustaining time period becomes short and sufficient luminance cannot be secured, or the time for increasing the number of subfields cannot be secured and the number of gradations to be displayed cannot be increased.

The present invention addresses the problems, and provides a driving method of a plasma display panel and a plasma display device. The method and device secure the time assigned to the sustaining time period or the time for increasing the number of subfields, and allow increase of luminance and high gradation display.

SUMMARY OF THE INVENTION

The present invention addresses the problems, and provides a driving method of a plasma display panel. The plasma display panel has the following elements:

- a plurality of display electrode pairs that extend in a row direction and form a display line;
- a plurality of data electrodes disposed in the direction crossing the display electrode pairs; and
- discharge cells formed at intersections of the data electrodes and the display electrode pairs.

In this method, one field time period is formed of a plurality of subfields having at least a writing time period and a sustaining time period, of an initialization time period, the writing time period, and the sustaining time period. Each display electrode pair is divided into a plurality of blocks, and starting timings of the subfields of the blocks are set to be shifted so that writing timings of two or more blocks of the plurality of blocks do not coincide with each other.

DETAILED DESCRIPTION OF PREFERRED EMBODIMENTS

A driving method in accordance with an exemplary embodiment of the present invention will be described hereinafter with reference to the following drawings.

First Exemplary Embodiment

Figure 1:
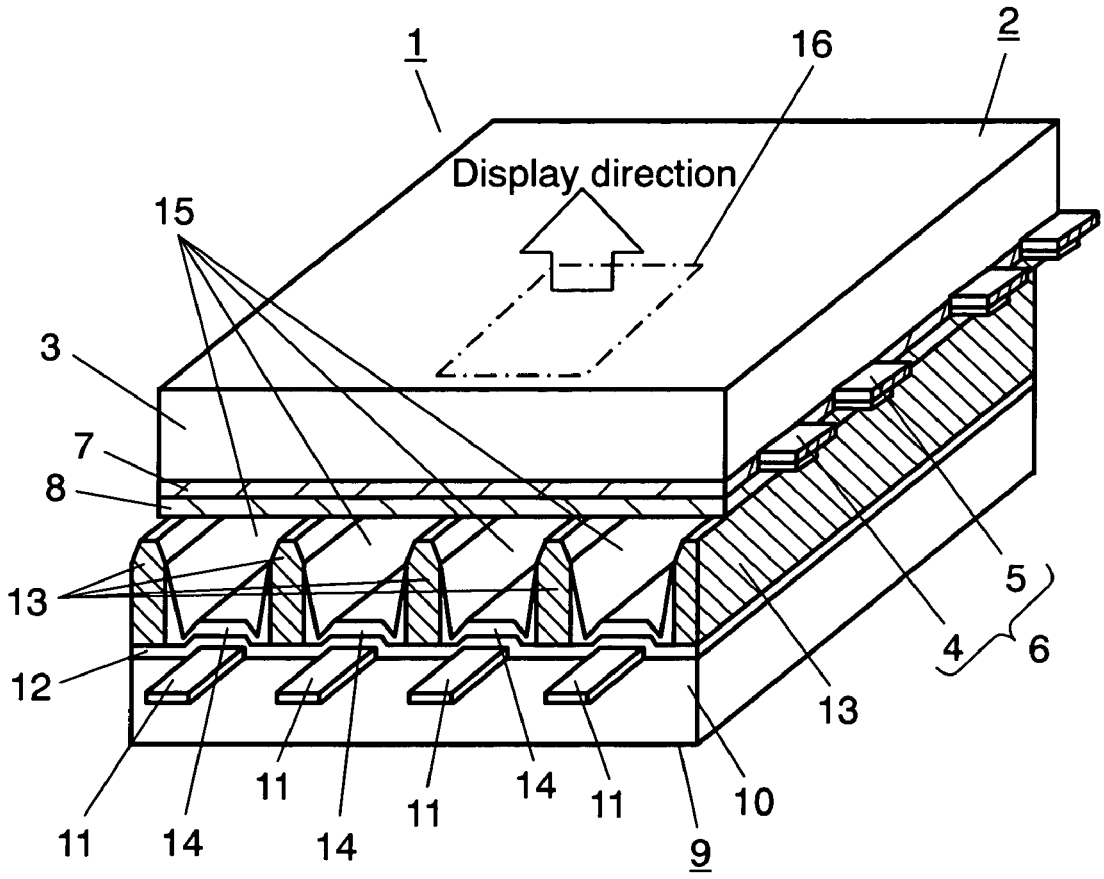
FIG. 1 is a perspective view showing an essential part of a panel used in a plasma display device in accordance with an exemplary embodiment of the present invention.

FIG. 1 is a perspective view showing an essential part of a panel used in an exemplary embodiment of the present invention. Panel 1 has front plate 2 and back plate 9 that are faced to each other, and a discharge space is formed between front plate 2 and back plate 9. In front plate 2, a plurality of pairs of parallel scan electrodes 4 and sustain electrodes 5, which form display electrodes, are formed on front glass substrate 3. Dielectric layer 7 is formed so as to cover scan electrodes 4 and sustain electrodes 5, and protective layer 8 is formed on dielectric layer 7. Here, a pair of scan electrodes 4 and sustain electrodes 5 form display electrode pair 6.

In back plate 9, a plurality of data electrodes 11 covered with insulator layer 12 are formed on back glass substrate 10, and barrier ribs 13 are disposed on insulator layer 12, between data electrodes 11, and in parallel with data electrodes 11. Phosphor layers 14 of red, green, and blue are formed on the surface of insulator layer 12 and on side surfaces of barrier ribs 13. Front plate 2 and back plate 9 are faced to each other in the intersecting direction of scan electrodes 4 and sustain electrodes 5 with data electrodes 11. Discharge spaces 15 formed between front plate 2 and back plate 9 are filled with discharge gas such as mixed gas of neon and xenon. The intersection of each display electrode pair 6 and data electrode 11 in discharge space 15 works as discharge cell 16, namely a unit light emitting region.

Figure 2:
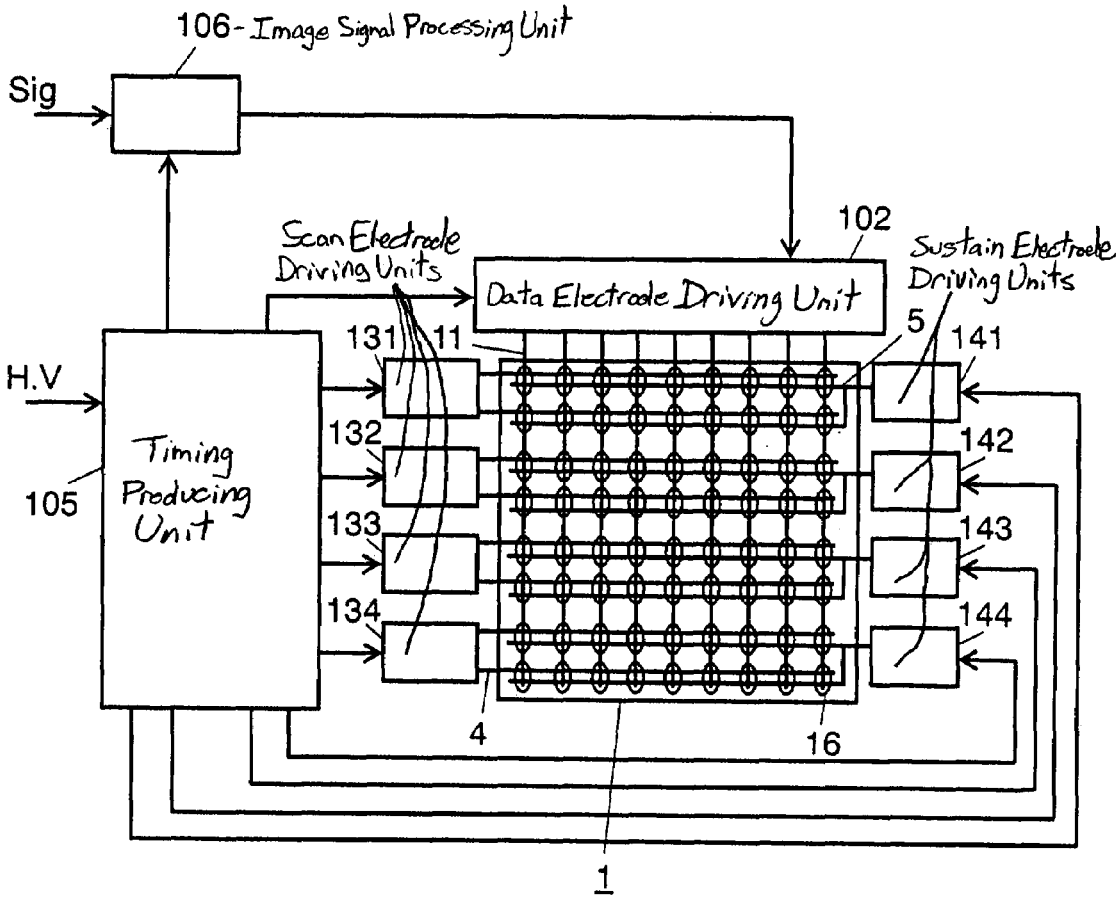
FIG. 2 shows a driving circuit block and an electrode array of the panel in the plasma display device.

FIG. 2 shows a driving circuit block and an electrode array of the panel in the exemplary embodiment of the present invention. In this embodiment, display electrode pair 6 of panel 1 is divided into four blocks, scan electrode 4 and sustain electrode 5 belonging to the block are independently driven. The plasma display device has the following elements:

- image signal processing unit 106 for converting image signal Sig to image data at each subfield;
- data electrode driving unit 102 for converting the image data at each subfield to a signal corresponding to each data electrode 11 and for driving data electrode 11;
- timing producing unit 105 for producing various timing signals in response to horizontal synchronizing signal H and vertical synchronizing signal V;
- four scan electrode driving units 131 to 134 and four sustain electrode driving units 141 to 144 for driving scan electrodes 4 and sustain electrodes 5 in four blocks in response to respective timing signals, respectively; and
- panel 1 for displaying an image.

In the present embodiment, as shown in FIG. 2, display electrode pair 6 of panel 1 is divided into four blocks, and four scan electrode driving units 131 to 134 for driving scan electrodes 4 in respective blocks and four sustain electrode driving units 141 to 144 for driving sustain electrodes 5 in respective blocks are independently disposed. As described later, these driving units drive the blocks at different timings.

Driving voltage waveforms for driving the panel and their operations are described hereinafter. In the present embodiment, the number of display electrode pairs of the panel is 384 (768×½), one field is formed of 20 subfields (1SF, 2SF, . . . , 20SF), only first subfield has an initialization time period, and driving is performed so as to continue subfields at which light is emitted. The number of sustaining pulses in each sustaining time period in each subfield is 222, 208, 194, 180, 166, 152, 140, 126, 114, 102, 90, 78, 68, 56, 46, 36, 28, 18, 12, or 4.

Figure 3:
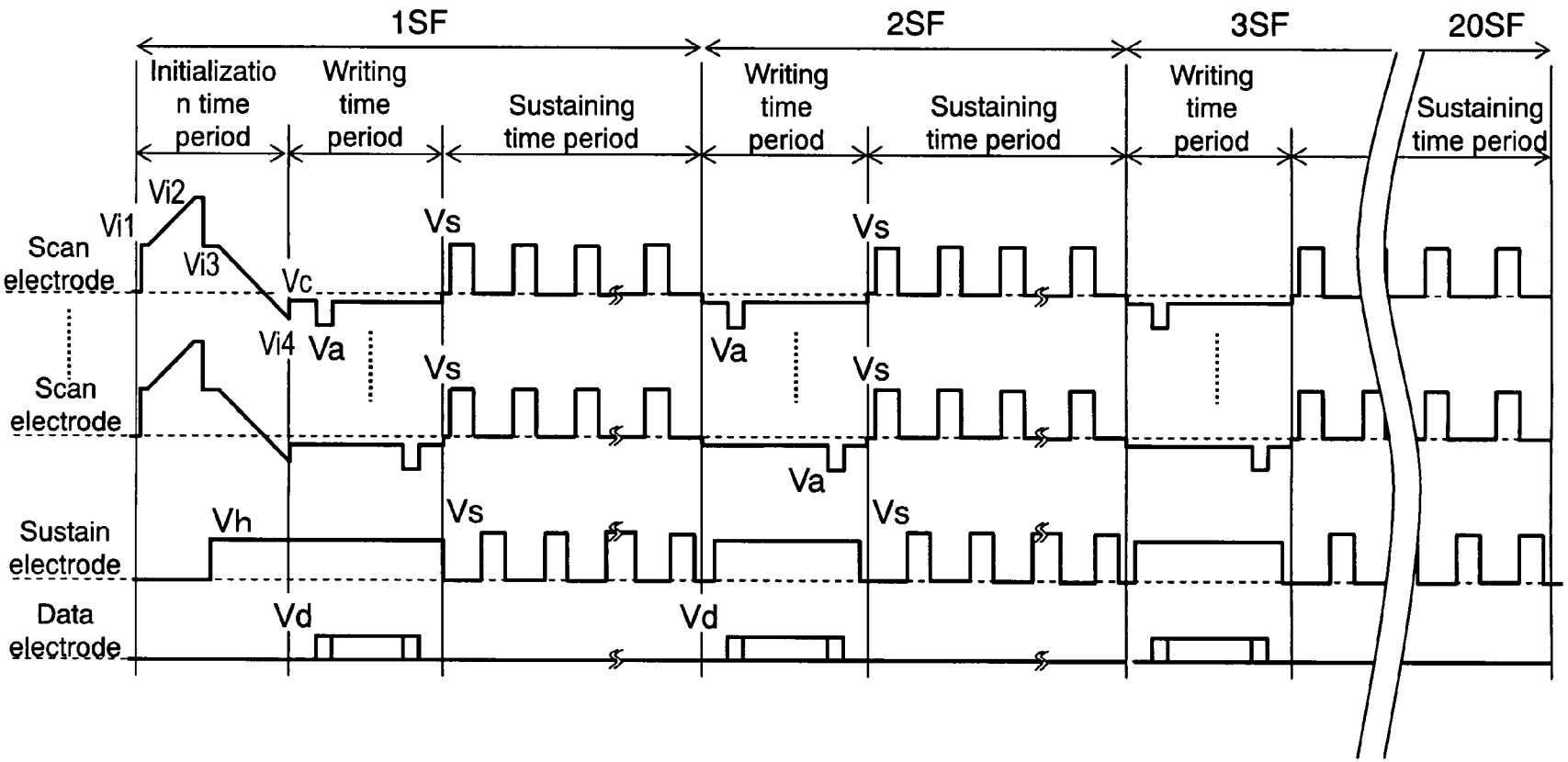
FIG. 3 shows a waveform chart of a driving voltage applied to each electrode in one block of the plasma display device.

A driving method of one block is firstly described. FIG. 3 shows a waveform chart of a driving voltage applied to each electrode in one block. In the initialization time period of 1SF in the block, voltages applied to data electrodes 11 and sustain electrodes 5 are kept 0 (V), and a lamp voltage is applied to scan electrodes 4. This lamp voltage gently increases from voltage Vi1 (V) that is not higher than a discharge start voltage, to voltage Vi2 (V) exceeding the discharge start voltage. Then, positive voltage Vh (V) is continuously applied to sustain electrodes 5, and a lamp voltage is applied to scan electrodes 4. This lamp voltage gently decreases from voltage Vi3 (V) to voltage Vi4 (V). At this time, two weak initialization discharges occur in all discharge cells, the wall voltage on scan electrodes 4 and the wall voltage on sustain electrodes 5 are decreased, and the wall voltage on data electrodes 11 is adjusted to a value appropriate to a writing operation. The wall voltage on the electrodes means a voltage generated by the wall charge accumulated on dielectric layer 7, protective layer 8, or phosphor layer 14 that cover the electrodes.

In the subsequent writing time period, the voltage applied to scan electrodes 4 is temporarily kept Vc (V). Then, positive writing pulse voltage Vd (V) is applied to data electrode 11 corresponding to a discharge cell to be displayed in the first row of the block, of data electrodes 11, and scan pulse voltage Va (V) is applied to scan electrode 4 in the first row of the block. Discharge occurs between data electrode 11 to which writing pulse voltage Vd (V) is applied and scan electrode 4 in the first row, and develops to discharge between this scan electrode 4 and sustain electrode 5. Thus, writing discharge is selectively produced in the discharge cell to be displayed in the first row, and the writing operation of accumulating the wall voltage on each electrode is performed. The writing operation discussed above is sequentially continued to the discharge cell in the final row of the block.

In the subsequent sustaining time period, positive sustaining pulse voltage Vs (V) is applied alternately to sustain electrodes 5 and scan electrodes 4. At this time, in the discharge cell where the writing discharge has occurred, the voltage between scan electrodes 4 and sustain electrodes 5 becomes equal to the summation of sustaining pulse voltage Vs (V) and the wall voltage accumulated by the writing operation, and exceeds the discharge start voltage to produce sustaining discharge. In the writing time period, the sustaining discharge is not produced in the discharge cell where the writing discharge does not occur.

The subfield of 2SF or later in the block has no initialization time period, and is formed of a writing time period and a sustaining time period. In the discharge cell where the sustaining discharge has occurred at the immediately previous subfield, the sustaining discharge occurs in the sustaining time period even when no writing operation is performed in the writing time period. In the panel driving method of the present embodiment, thus, subfields at which light is emitted are continued. Here, operations in the writing time period and sustaining time period in the subfield of 2SF or later are the same as those in 1SF, so that the descriptions of these operations are omitted.

Figure 4:
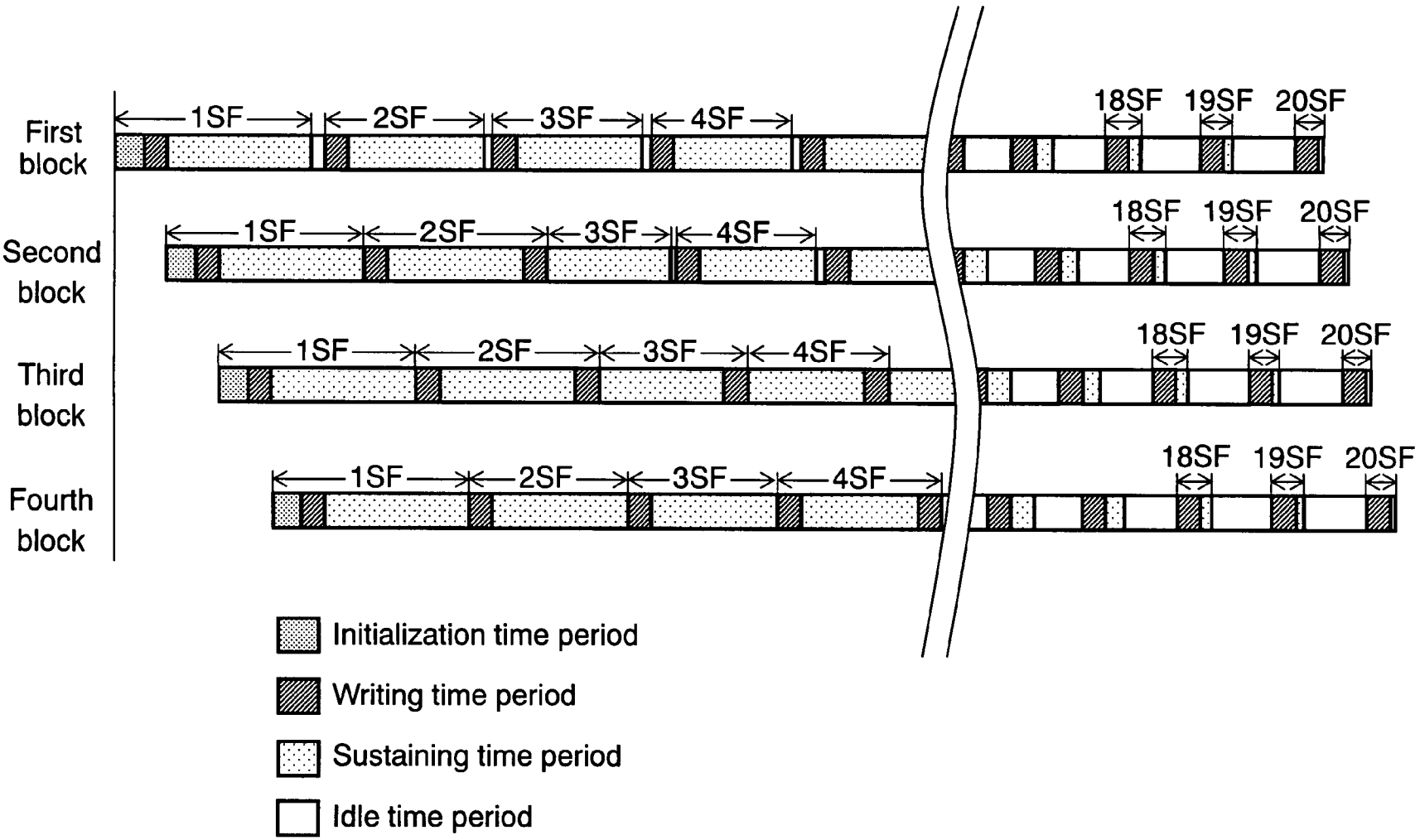
FIG. 4 shows timings of an initialization time period, a writing time period, and a sustaining time period in each subfield in four blocks in accordance with exemplary embodiment 1 of the present invention.

A driving method of each of four blocks of display electrode pair 6 is described hereinafter. FIG. 4 shows timings of the initialization time period, writing time period, and sustaining time period in each subfield in four blocks in accordance with exemplary embodiment 1. The vertical axis shows four blocks, and the horizontal axis shows time.

The initialization time period is firstly started in 1SF in the first block. After the initialization time period, the writing time period is started in 1SF in the first block. After the writing time period in the first block, the sustaining time period is started in the first block and the initialization time period is started in 1SF in the second block. After the initialization time period in the second block, the writing time period is started in the second block. After that, the similar operations are performed. In other words, after the writing time period in the second block, the sustaining time period is started in the second block and the initialization time period and the writing time period are sequentially started in 1SF in the third block. After the writing time period in the third block, the sustaining time period is started in the third block and the initialization time period and the writing time period are sequentially started in 1SF in the fourth block.

After the writing time period in the fourth block, the sustaining time period is started in the fourth block, and the writing time period is started in 2SF in the first block when the sustaining time period has finished in the first block. When the sustaining time period has not finished in the first block, the writing time period in 2SF in the first block is not started, and is started after the finish of the sustaining time period. After the writing time period in the first block, the sustaining time period is started in the first block, and the writing time period is started in 2SF in the second block when the sustaining time period has finished in the second block. When the sustaining time period has not finished in the second block, the writing time period in 2SF in the second block is not started, and is started after the finish of the sustaining time period. After that, similarly, the writing time periods in the third block and the fourth block are provided not to coincide with the writing time periods of the other blocks. In the description discussed above, a time period belonging to none of the initialization time period, the writing time period, and the sustaining time period can occur, and this time period is called "an idle time period".

After the writing time period in 20SF in the fourth block, the sustaining time period is started in the fourth block, and, when the sustaining time period has finished in the first block, the initialization time period is started in 1SF, namely the next field, in the first block. When the sustaining time period has not finished in the first block, the initialization time period is not started, and is started after the finish of the sustaining time period. An adjusting time period for matching the length of one field with 1/60 s may be provided between 20SF and the next field 1SF.

Thus, the driving time of one field can be shortened, by dividing the display electrode pair into a plurality of blocks and by driving the blocks with the phases shifted so that the writing time period in each block does not coincide with the writing time period or the initialization time period in each block. For example, assuming that the length of the initialization time period is 200 μs, the writing time period for one display electrode pair is 1.7 μs, the number of display electrode pairs in each block is 96, and the width of the sustaining pulse is 4.5 μs, a subfield structure having 20 SFs in 15.8 ms is allowed, as shown in FIG. 4.

If the subfield structure having 20 SFs is provided under the same condition as that in a conventional driving method, 20.9 ms is required and exceeds the time 16.6 ms of one field. Therefore, this subfield structure cannot be realized.

As discussed above, the starting timing of the subfield in each block is shifted in time so that the writing time periods in two or more blocks of the plurality of blocks do not coincide with each other. Therefore, the sustaining time period in one block can coincide with the writing time period and the initialization time period of the other block, the driving time for one field can be shortened, and the number of subfields can be increased to increase the number of displayable gradations. The sustaining time period may be elongated to increase the luminance.

In the present embodiment, display electrode pair 6 is divided into four blocks, namely the number of blocks is four. The driving time is long in either of the cases that the number of blocks is excessively large and that the number is excessively small. The reason is described below. When the number of blocks is increased, the sustaining time period can be made to coincide with the writing time period and hence the driving time can be shortened by the coinciding amount. However, the initialization time periods are shifted in time in respective blocks, and hence the driving time becomes long by the shifted amount. It is therefore preferable that the number of blocks is optimized based on various conditions such as the number of scan electrodes, the number of subfields, existence of the initialization time period in each subfield, the number of sustaining pulses, and times required for writing discharge and sustaining discharge.

In the present embodiment, a driving method using a positive logic is described. In this method, the initialization time period is provided only in the first subfield, and a writing operation for starting the lighting from a desired subfield is then performed. However, a driving method using a negative logic may be employed. In this method, subfields are continuously lighted, and a writing operation for eliminating the wall charge is performed in a desired subfield to stop sustaining light emission. A driving method formed of a combination of these methods may be employed.

Second Exemplary Embodiment

A panel and driving circuit employed in exemplary embodiment 2 of the present invention is the same as those in exemplary embodiment 1. One field is formed of 20 subfields, an initialization time period is provided only in the first subfield 1SF, and a driving for continuing subfields in which light is emitted is performed, similarly to exemplary embodiment 1. In exemplary embodiment 2, lengths of subfields 2SF to 20SF other than the first subfield are set equal to each other in each block, and the sustaining time period of the first subfield 1SF is back-aligned in 1SF in each block, differently from exemplary embodiment 1.

Figure 5:
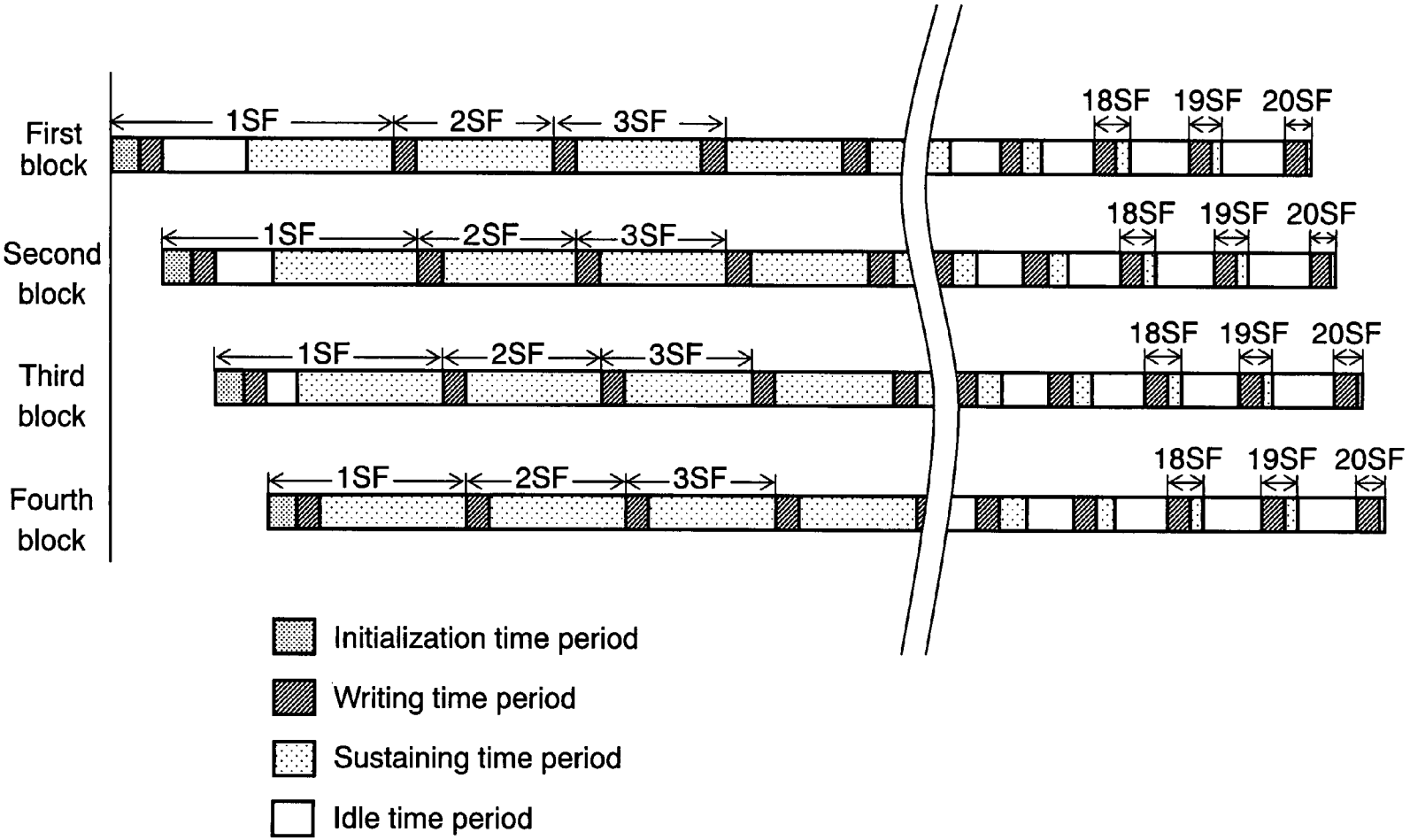
FIG. 5 shows timings of an initialization time period, a writing time period, and a sustaining time period in each subfield in four blocks in accordance with exemplary embodiment 2 of the present invention.

FIG. 5 shows timings of an initialization time period, a writing time period, and a sustaining time period in each subfield in four blocks in accordance with exemplary embodiment 2 of the present invention. The vertical axis shows four blocks, and the horizontal axis shows time. The operations in the initialization time period and the writing time period are firstly performed in 1SF in the first block. After the writing time period, the initialization time period is started in 1SF in the second block, similarly to exemplary embodiment 1. In the first block, however, an idle time period is started and the sustaining time period is then started. The length of the idle time period is equal to a value derived by subtracting the sum of the idle time periods in 1SF to 20SF in the fourth block from the sum of the idle time periods in 1SF to 20SF in the first block of embodiment 1. In other words, the excess part of the total idle time period in the first block comparing with the total idle time period in the fourth block is set as the idle time period after the writing time period in 1SF of the first block. In the second block, similarly, after the writing time period in the second block, the idle time period is started in the second block, and the operations in the initialization time period and the writing time period are performed in 1SF in the third block. The length of the idle time period in the second block is also equal to the excess period of the total idle time period in the second block comparing with the total idle time period in the fourth block. After the idle time period in the second block, the sustaining time period in the second block is started. In the third block, similarly, after the writing time period in the third block, the idle time period is started in the third block, and the operations in the initialization time period and the writing time period are performed in 1SF in the fourth block. After the idle time period in the third block, the sustaining time period is started in the third block.

When the first subfield 1SF is structured in each block as discussed above, the length of each subfield of 2SF or later in one block can be equalized to that in another block, the difference between starting timings of the sustaining time periods in adjacent blocks can be set at the length of the writing time period in each block, namely ¼ of the writing time period to all display electrode pairs in embodiment 2. This difference is the minimum of practicable values. In the first subfield 1SF, also, the sustaining time period is started after the idle time period in each block, thereby setting the difference between starting timings of the sustaining time periods in respective blocks at the minimum value. Thus, when the difference between starting timings of the sustaining time periods having light emission in the panel in respective blocks is set at the minimum value, an influence caused by dividing the panel into blocks and driving the panel can be prevented from exerting upon the visual sense.

After the writing time period in the fourth block, the sustaining time period is started in the fourth block, and the writing time period is started in 2SF in the first block when the sustaining time period has finished in the first block. When the sustaining time period has not finished in the first block, the writing time period in 2SF in the first block is not started, and is started after the finish of the sustaining time period. After the writing time period in the first block, the sustaining time period is started in the first block, and the writing time period is started in 2SF in the second block when the sustaining time period has been finished in the second block. When the sustaining time period has not finished in the second block, the writing time period in 2SF in the second block is not started, and is started after the finish of the sustaining time period. After that, similarly, the writing time periods in the third block and the fourth block are provided not to coincide with the writing time periods of the other blocks.

In embodiment 2, thus, when the writing time period for one display electrode pair is 1.7 μs and the number of display electrode pairs in each block is 96, the difference between starting timings of the sustaining time periods in respective blocks can be set at 41 μs. By setting the difference between the sustaining time periods having light emission of the panel in respective blocks at the minimum value, the influence caused by dividing the panel into blocks and driving the panel can be prevented form exerting upon the visual sense.

Third Exemplary Embodiment

A panel employed in exemplary embodiment 3 of the present invention is the same as that in exemplary embodiment 1. In exemplary embodiment 3, display electrode pair 6 of panel 1 is divided into three blocks. Three scan electrode driving units 131 to 133 for driving scan electrodes 4 in respective blocks and three sustain electrode driving units 141 to 144 for driving sustain electrodes 5 in respective blocks are independently disposed. As described later, these driving units drive the blocks at different timings.

Driving voltage waveforms for driving the panel and their operations are described hereinafter. In exemplary embodiment 3, the number of display electrode pairs of the panel is 384 (768×½), one field is formed of 10 subfields (1SF, 2SF, . . . , 10SF), all subfields have an initialization time period, and light emission or no light emission can be controlled in each subfield. The number of sustaining pulses in each sustaining time period in each subfield is constant-number N times larger than 66, 55, 44, 34, 25, 16, 8, 4, 2, or 1. When the constant-number N is set large, the number of sustaining pulses is increased and hence an image having high luminance can be displayed. The subfield structure where the number of sustaining pulses is set at N-times larger than the above value is called "N-times mode".

Figure 6:
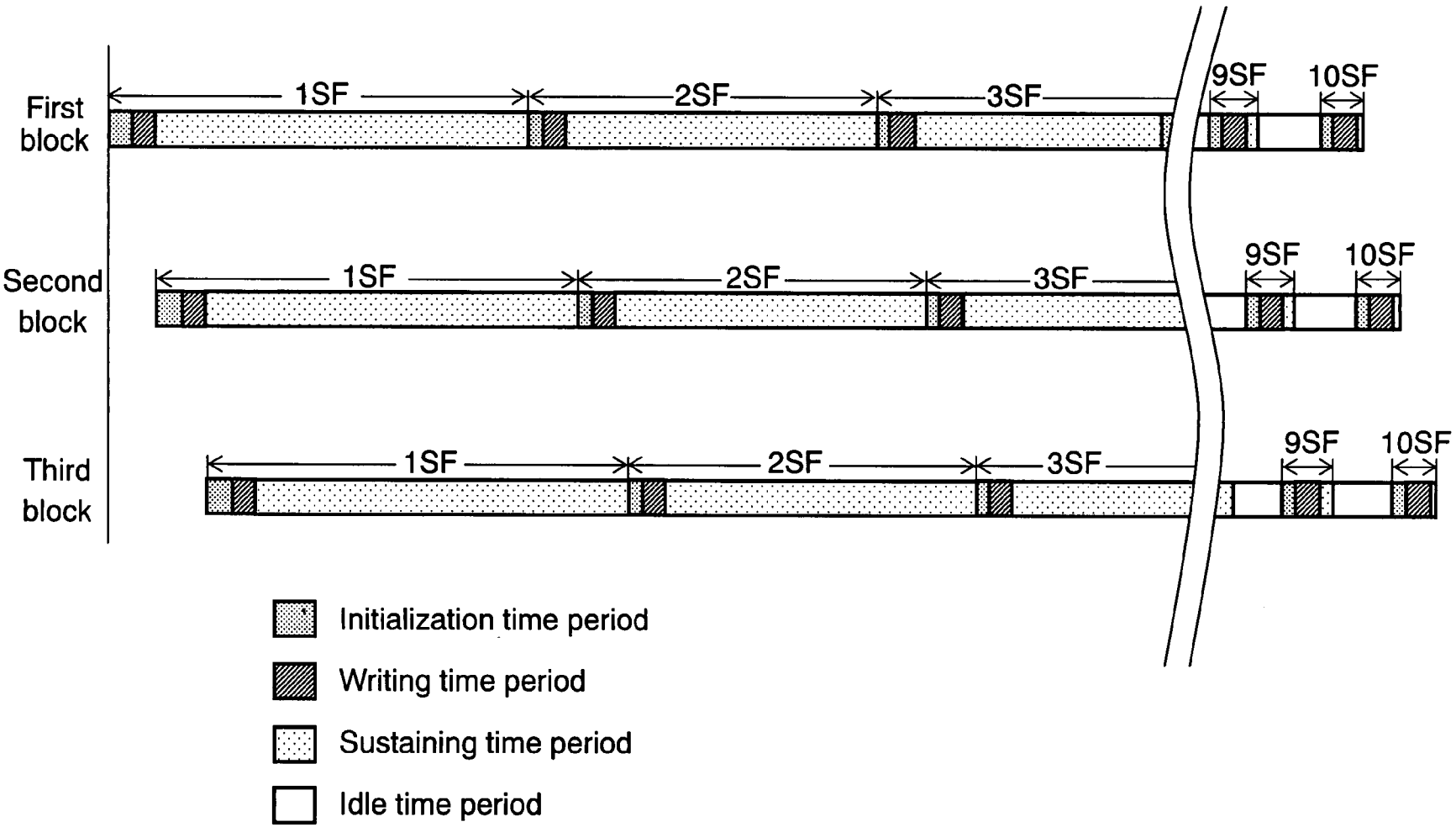
FIG. 6 shows timings of an initialization time period, a writing time period, and a sustaining time period in each subfield in four blocks in accordance with exemplary embodiment 3 of the present invention.

FIG. 6 shows timings of an initialization time period, a writing time period, and a sustaining time period in each subfield for three blocks. The vertical axis also shows three blocks, and the horizontal axis shows time.

The initialization time period is firstly started in 1SF in the first block. After the initialization time period, the writing time period is started in 1SF in the first block. After the writing time period in the first block, the sustaining time period is started in the first block and the initialization time period is started in 1SF in the second block. After the initialization time period in the second block, the writing time period is started in the second block. After that, the similar operations are performed. In other words, after the writing time period in the second block, the sustaining time period is started in the second block, and the initialization time period and the writing time period are sequentially started in the third block.

After the writing time period in the third block, the sustaining time period is started in the third block, the initialization time period and the writing time period are sequentially started in 2SF in the first block when the sustaining time period has finished in the first block. When the sustaining time period has not finished in the first block, the initialization time period and the writing time period in 2SF in the first block are not started, and are started after the finish of the sustaining time period. After the writing time period in the first block, the sustaining time period is started in the first block, and the initialization time period and the writing time period is sequentially started in 2SF in the second block when the sustaining time period has finished in the second block. When the sustaining time period has not finished in the second block, the initialization time period and the writing time period in 2SF in the second block are not started, and are started after the finish of the sustaining time period. After that, similarly, the initialization time period and the writing time period in the next block are provided not to coincide with the initialization time period and the writing time periods of the other block.

After the writing time period in 10SF in the third block, the sustaining time period is started in the third block, and, when the sustaining time period has finished in the first block, the initialization time period is started in 1SF, namely the next field, in the first block. When the sustaining time period has not finished in the first block, the initialization time period is not started, and is started after the finish of the sustaining time period. An adjusting time period for matching the length of one field with 1/60 s may be provided between 10SF and the next field 1SF, similarly to embodiment 1.

Thus, the driving time of one field can be shortened, by dividing the display electrode pair into a plurality of blocks and by driving the blocks with the phases shifted so that the writing time period in each block does not coincide with the writing time period or the initialization time period in the other block. For example, it is assumed that the length of the initialization time period in 1SF is 200 μs, the length of the initialization time periods in 2SF to 10SF is 100 μs, the writing time period for one display electrode pair is 1.7 μs, the number of display electrode pairs in each block is 96, and the width of the sustaining pulse is 4.5 μs. At this time, as shown in FIG. 6, even when constant-number N is set at "10", the total length of all subfields is 16.2 ms, and the luminance can be increased up to that in 10-times mode.

For realizing the 10-times mode under the same condition, 18.3 ms is required. This value exceeds the time 16.6 ms of one field, so that this subfield structure cannot be realized.

As discussed above, the starting timing of the subfield in each block is shifted in time so that the writing time periods in two or more blocks of the plurality of blocks do not coincide with each other. Therefore, the sustaining time period in one block can coincide with the writing time period and the initialization time period of the other block, and the number of sustaining pulses is increased to allow the display of an image having high luminance. The number of subfields may be increased to increase the number of displayable gradations.

In embodiment 3, display electrode pair 6 is divided into three blocks. For the reason described in embodiment 1, the driving time is long in either of the cases that the number of blocks is excessively large and that the number is excessively small. It is therefore preferable that the number of blocks is optimized based on various conditions such as the number of scan electrodes, the number of subfields, the number of sustaining pulses, and times required for writing discharge and sustaining discharge.

In the present invention, the time assigned to the sustaining time period or the time for increasing the number of subfields can be secured, and a driving method of a plasma display panel and a plasma display device that allow high luminance and high gradation display can be realized.

INDUSTRIAL APPLICABILITY

In a driving method of a plasma display panel of the present invention, the time assigned to the sustaining time period or the time for increasing the number of subfields can be secured, and high luminance and high gradation display are allowed. This driving method is useful for a driving method of a plasma display panel and a plasma display device.

The invention claimed is:

1. A driving method of a plasma display panel, the plasma display panel comprising:

a plurality of display electrode pairs that extend in a row direction and form a display line;

a plurality of data electrodes disposed in the direction crossing the display electrode pairs; and discharge cells formed at intersections of the data electrodes and the display electrode pairs, wherein one field time period comprises:

at least one subfield that has an initializing time period, a writing time period and a sustaining time period, and a plurality of subfields that have a writing time period and a sustaining time period, and do not have an initializing time period, the driving method of the plasma display panel comprising:

dividing each display electrode pair into a plurality of blocks;

setting, in at least one subfield that has an initializing time period, a writing time period and a sustaining time period, a difference between starting timings of subfields in adjacent blocks, so as to correspond to the initializing time period and the writing time period; and setting, in the plurality of subflelds that have a writing time period and a sustaining time period, a difference between starting timings of subflelds in adjacent blocks, so as to correspond to the writing time period.

2. The driving method of a plasma display panel according to claim 1, further comprising including one initialization time period in only the first subfield in each field.

3. A plasma display device comprising:

a plasma display panel including:

a plurality of scan electrodes and a plurality of sustain electrodes forming a plurality of display electrode pairs, the display electrode pairs extending in a row direction and forming a display line;

a plurality of data electrodes disposed in the direction crossing the display electrode pairs; and discharge cells at intersections of the data electrodes and the display electrode pairs, a plurality of scan electrode driving units individually corresponding to a plurality of blocks, the plurality of blocks being formed by dividing the display electrode pair; and a plurality of sustain electrode driving units individually corresponding to a plurality of blocks, wherein one field time period comprises:

at least one subfield that has an initializing time period, a writing time period, and a sustaining time period, and a plurality of subfields that have a writing time period and a sustaining time period, and do not have an initializing time period, wherein the plasma display device is driven by a driving method comprising:

dividing each display electrode pair into a plurality of blocks;

setting, in at least one subfield that has an initializing time period, a writing time period, and a sustaining time period, a difference between starting timings of subfields in adjacent blocks, so as to correspond to the initializing time period and the writing time period; and setting, in the plurality of subfields that have a writing time period and a sustaining time period, a difference between starting timings ofsubfields in adjacent blocks, so as to correspond to the writing time period.

* * * * *

UNITED STATES PATENT AND TRADEMARK OFFICE

CERTIFICATE OF CORRECTION

PATENT NO. : 7,411,570 B2
APPLICATION NO. : 10/533130
DATED : August 12, 2008
INVENTOR(S) : Toru Kawase et al.

It is certified that error appears in the above-identified patent and that said Letters Patent is hereby corrected as shown below:

In column 10, line 53, claim 4, please replace “starting timing ofsubfields” with “starting timing of subfields”.

Signed and Sealed this

Third Day of March, 2009

JOHN DOLL
*Acting Director of the United States Patent and Trademark Office*